US006799684B2

(12) United States Patent
Wooldridge

(10) Patent No.: US 6,799,684 B2
(45) Date of Patent: Oct. 5, 2004

(54) MULTI-HEAD PORTIONING SYSTEM

(75) Inventor: Donald R. Wooldridge, Dunkirk, MD (US)

(73) Assignee: Batching Systems, Inc., Prince Frederick, MD (US)

( * ) Notice: Subject to any disclaimer, the term of this patent is extended or adjusted under 35 U.S.C. 154(b) by 22 days.

(21) Appl. No.: 10/270,079

(22) Filed: Oct. 15, 2002

(65) Prior Publication Data

US 2004/0069692 A1 Apr. 15, 2004

(51) Int. Cl.[7] ..... B07C 5/00
(52) U.S. Cl. ..... 209/551; 209/652; 209/908
(58) Field of Search ..... 209/551, 559, 209/576, 580, 586, 592, 645, 650, 652, 908, 911, 913, 920, 933; 377/6, 10, 11

(56) References Cited

U.S. PATENT DOCUMENTS 3,123,217 A * 3/1964 McMillan et al. ..... 209/555
3,394,804 A * 7/1968 Reichel ..... 209/570
3,606,011 A * 9/1971 Jeddeloh ..... 209/520
3,618,819 A * 11/1971 Blackburn et al. ..... 221/2
5,454,016 A * 9/1995 Holmes ..... 377/6
5,804,772 A * 9/1998 Wooldridge et al. ..... 177/116
6,360,870 B1 * 3/2002 Wooldridge ..... 198/391
6,563,901 B2 * 5/2003 Wooldridge ..... 377/11

FOREIGN PATENT DOCUMENTS

GB 2277391 A * 10/1994 ..... G06M/7/04

* cited by examiner

*Primary Examiner*—Donald P. Walsh
*Assistant Examiner*—Joseph Rodriguez
(74) *Attorney, Agent, or Firm*—Crowell & Moring LLP

(57) ABSTRACT

A counting and portioning system which counts discrete articles that conform to predetermined specifications into lots having a predetermined number of articles or a target volume. The system includes at least one portioning bin positioned to receive articles from a conveyor. The at least one bin has at least first and second outlet gates for emptying articles into separate respective first and second locations. A scanner detects and maintains a count of articles that are received in the at least one portioning bin and fall within the predetermined specification. The detector unit generates an out-of-specification signal when an article or group of articles received in the at least one portioning bin falls outside the predetermined specification. A control unit causes the first outlet gate to open when the count or volume of articles is equal to the predetermined number and causes the second outlet gate to open in response to receipt of an out-of-specification signal. The profile/volume signature for every part scanned and delivered from the infeed to the scanner is stored.

27 Claims, 8 Drawing Sheets

MULTI-HEAD PORTIONING SYSTEM

BACKGROUND AND SUMMARY OF THE INVENTION

This invention relates to an apparatus and method for detecting and discriminating articles that are within a predetermined range of a specification into lots. More particularly, this invention relates to an apparatus and method for detecting and discriminating articles as aforesaid that have been separated and singulated while being conveyed to the apparatus of the present invention. The specification could be volume, individual or total, of articles; size or other physical characteristic of the articles; count of articles; or combinations of these properties.

Devices for counting or aggregating articles are known. For example, U.S. Pat. Nos. 5,313,508 and 5,454,016, which are incorporated herein by reference in their entireties, disclose methods and apparatus for counting irregularly shaped articles. A pair of alternately energized light sources is provided at a sensing plane through which articles to be counted pass. Each of the light sources emits a light beam that is at an angle to the other light beam, such as an angle of about 90°.

U.S. Pat. No. 5,804,772, which is incorporated herein by reference in its entirety, discloses an apparatus and method for aggregating a desired number of articles without individually counting out each article to achieve the desired number. A stream of the articles is discharged into a weigh hopper until substantially a predetermined weight of articles is in the hopper. The number of articles in the hopper is determined from the total weight of the hopper and the weight of a single article.

U.S. Pat. No. 6,360,870, which is incorporated herein by reference in its entirety, discloses an apparatus which comprises a plurality of outlets radiating outwardly from the periphery of a feeder bowl. The number of outlets can be as few as two with no upper limit except as dictated by physical constraints. It is possible that as many as about 100 could be used depending on bowl size and/or diameter, and track size. Specifically, the device has multiple tracks spiraling or radially exiting out from a center cone or other structure. The tracks all have tooling designed to shed bulk loose product down to single file feed, exiting product in controlled flow from the bowl around the entire periphery at the end of each track. The bowl passes the excess overflow via an integral catch pan that provides a path for the bulk excess product to exit the bowl feeder from underneath the multiple tracks for a return run through the multi-track feeder. At each exit, an optical parts detector, laser, light beam, load cell, or similar type device, with a product diverter gate, and an accumulator with discharge gates, is positioned to count, weigh, apportion by volume, discriminate by some other characteristic of the articles, or some combination of these properties, the loose product into the desired batch size or volume. These detectors may combine their counts for large batch sizes, or each be individually programmed to count each total batch or any combination of these optical batches and weighed batches satisfying their requested batch size or volume.

In another aspect of the invention of the aforementioned U.S. Pat. No. 6,360,870, a bowl configuration is provided for bulk product distribution that can deliver product uniformly and/or oriented in a controlled fashion out its entire periphery overflowing out of itself evenly and smoothly around a 360 degree circle. This bowl is designed to receive bulk product from bucket conveyors, bin vibratory elevators, and/or other similar delivery means. This device by nature of its design shape will collect the product in the bottom center of a cone, bowl or other similar shaped device. The bowl has spiral vanes, tracks, diverters, or other similar devices affixed to its interior surfaces that will guide and encourage the product to climb out of and spread itself evenly and uniformly out of the periphery of the device.

Because previously known devices do not detect and package a lot of articles having a predetermined count and a predetermined size and reject lots having articles falling outside the predetermined size range, in my copending application Ser. No. 09/970,658, filed Oct. 5, 2001, which is incorporated herein by reference in its entirety, I disclose a counter unit for counting discrete articles within a predetermined size range into lots having a predetermined number of articles. The counter unit includes (1) a first conveyor that delivers a flow of articles separated at intervals, and (2) at least one bin positioned to receive articles from the conveyor. The at least one bin may have first and second outlet gates for emptying the articles into first and second separate locations. A detector unit counts the articles that are received from the conveyor into the at least one bin and which fall within the predetermined size range.

A control unit causes the first outlet gate to open when the count of articles is equal to the predetermined number of articles. However, when an article falls outside the predetermined size range, the detector generates an out-of-size signal. The control unit, upon receipt of the out-of-size signal from the detector unit, causes the second outlet gate to open, thereby rejecting the articles. The counter unit may also be used to for counting articles having a predetermined color into lots having a predetermined number of articles. When an article does not have the predetermined color, the detector generates an out-of-color signal. The control unit, upon receipt of the out-of-color signal from the detector unit, causes the second outlet gate to open, thereby rejecting the articles.

The counter unit of the aforementioned application Ser. No. 09/970,658 is quick and efficient. There is a need, however, for an improvement on that counter unit which is more suitable for: use with certain applications. In particular, although as non-limiting examples, in packaging of pharmaceutical dosage forms such as pills, capsules, or the like; or of foods such as soups or other mixtures of various ingredients, apportioning the articles by gross volume is more efficient.

It is, therefore, an object of the present invention to overcome the deficiencies of prior art devices and methods and to provide an apparatus and method for apportioning articles that accurately counts a predetermined number of discrete articles, regardless of size and/or shape, and/or dispenses articles that are within predetermined specifications such as total size or volume.

It is another object of the present invention to provide an article detecting and counting or volume totaling apparatus that is relatively simple and inexpensive to manufacture and to maintain and that is both accurate and reliable.

It is still another object of the present invention to provide a method of counting and portioning articles accurately and efficiently Consistent with the foregoing objects, the present invention provides an article detecting and counting apparatus which comprises a detector unit which detects and maintains a count of articles that are received in the apparatus or which fall within a predetermined range of a predetermined specification such as volume, which detector generates an out-of-specification signal when an article or group of articles received in the apparatus falls outside the predetermined range; a chamber positioned to receive articles from a flow of articles delivered to the apparatus; a diverter gate which holds and releases batches of articles for further processing, the diverter gate being disposed in the chamber; at least first and second outlet gates for emptying articles from apparatus into respective first and second locations which are separated from each other; and a control unit which causes the first outlet gate to open when the count or volume of articles is equal to the predetermined number and/or the articles fall within the predetermined range of the predetermined volume, for example, and causes the second outlet gate to open in response to receipt of an out-of-specification signal from the scanner.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
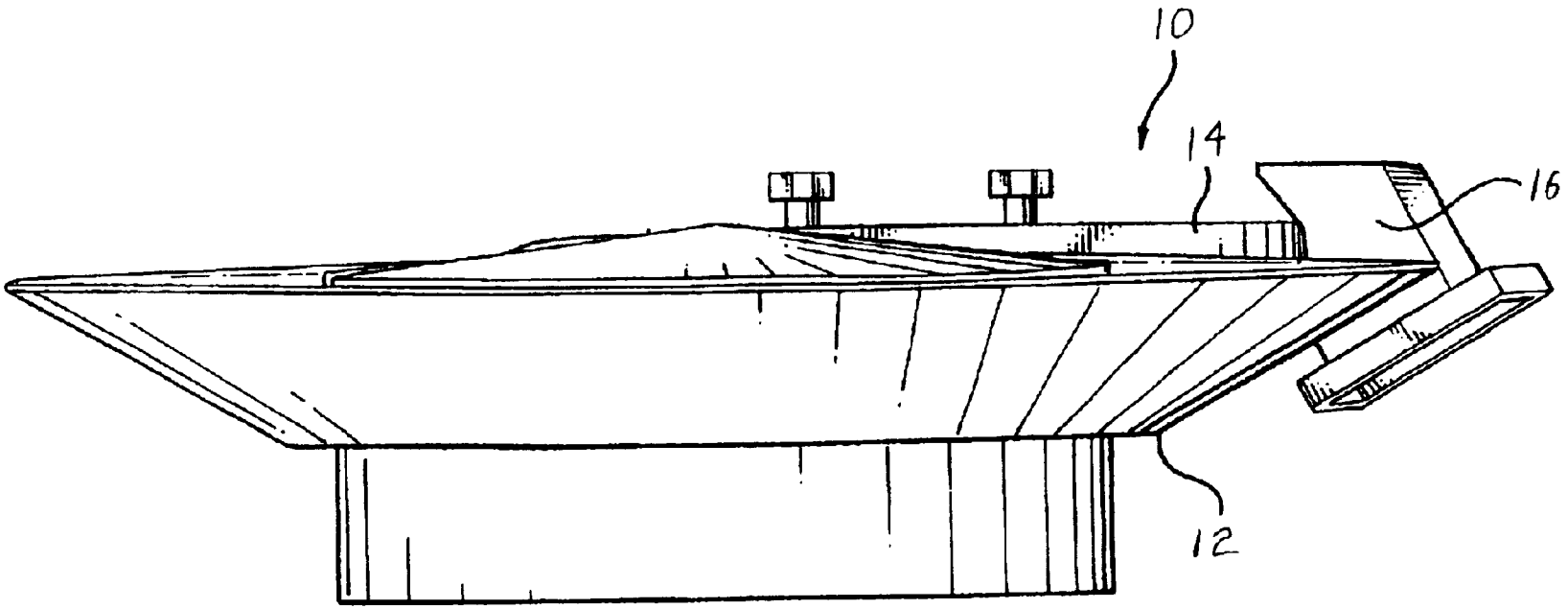
FIG. 1 is a perspective view from the top and front of a bowl feeder schematically showing the placement of the counting and portioning system of the present invention.

Referring first to FIG. 1, there is shown a bowl feeder generally designated by the numeral 10 according to the aforementioned U.S. Pat. No. 6,360,870. The bowl feeder 10 has a central receiving section 12 which receives bulk product to be distributed to the counting and portioning system. The product could be pieces of food such as carrots, potatoes, pasta, or any other type of food which can be handled in bulk and separated into discrete units to have volume determined, to be counted, measured, weighed, or subjected to measurement of any other physical characteristic such as color, shape, or the like, or combinations such as volume determinations combined with count; pharmaceutical products such as tablets, capsules, or any other dosage form which can be subjected to handling; electronic components such as chips, resistors, capacitors, transistors, or the like; or any other type of product to be separated from bulk quantities into individual or multiple package units.

The bowl feeder 10 shown is a vibratory feeder. Due to the vibration, the bulk product is moved along one or more tracks 14 spiraling or radiating out from the center of the apparatus. This movement separates and singulates (causes the product to assume a single file) the product. Only one track 14 is shown in FIG. 1 but it is understood that there may be as many as 100, or more, channels, the number being dictated only by practical considerations such as the size of the installation. A device for counting, sorting, combining, weighing, separating, or the like is affixed to the end of a track as is shown schematically at 16.

Figure 2:
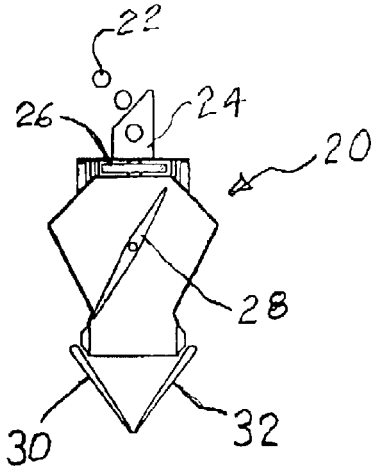
FIG. 2 is an elevational view, schematically shown for illustrative clarity, of one embodiment of the counting and portioning system of the present invention.
Figure 3:
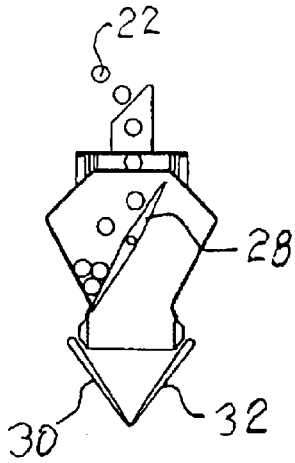
FIG. 3 is an elevational view of the embodiment of FIG. 1 showing the diverter gate in a holding position.
Figure 4:
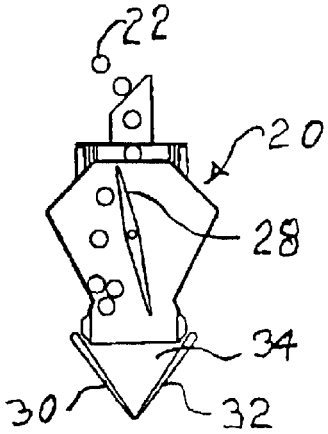
FIG. 4 is an elevational view of the embodiment of FIG. 1 showing the diverter gate allowing a first batch to proceed to the next position.
Figure 5:
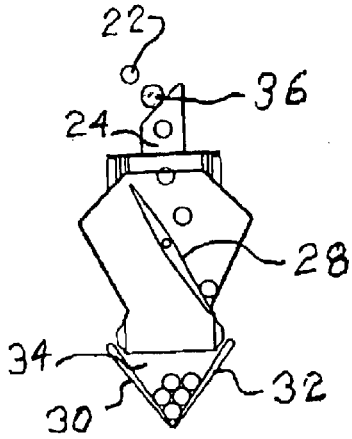
FIG. 5 is an elevational view of the embodiment of FIG. 1 showing the first batch being held while the diverter gate is in holding position for a second batch.

One embodiment of the counting and portioning system of the present invention is shown in FIG. 2, generally designated by the numeral 20. Parts 22 which have been singulated by the device 10 enter the system at the inlet end 24 to be optically scanned by scanner 26. Scanner 26 is any suitable detecting device such as that of the aforementioned U.S. Pat. No. 5,313,508. Diverter gate 28 is in a first position to accumulate a batch of a predetermined number or volume of parts 22. Accept gate 30 and reject gate 32 are both in the closed positions. In FIG. 3, the parts 22 have all passed through scanner 26, are within the predetermined specifications, and are accumulating. In FIG. 4, the batch count or volume is completed, that is, the predetermined number or volume of in-specification parts 22 has accumulated. The diverter gate 28 swings to its second position allowing the first batch to drop down into the holding area at the outlet end 34 of device 20. Accept gate 30 and reject gate 32 are still closed. As shown in FIG. 5, while the first batch is being held at 34, a new batch is entering at inlet end 24, with diverter gate 28 holding the new batch. The new batch shown will include an item 36 which is out of specification. It is to be understood that out-of-specification article 36 is shown schematically and could, in fact, be a cluster of items which, collectively, do not meet the prescribed specification such as volume.

Figure 6:
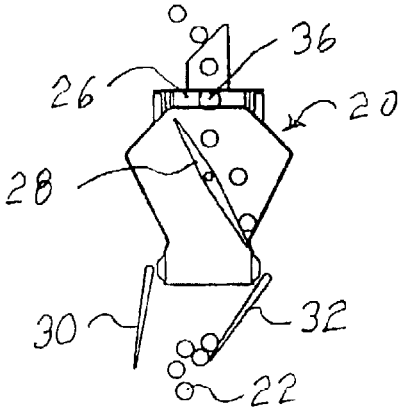
FIG. 6 is an elevational view of the embodiment of FIG. 1 showing the first batch being dispensed while the diverter gate is in a holding position for a second batch.
Figure 7:
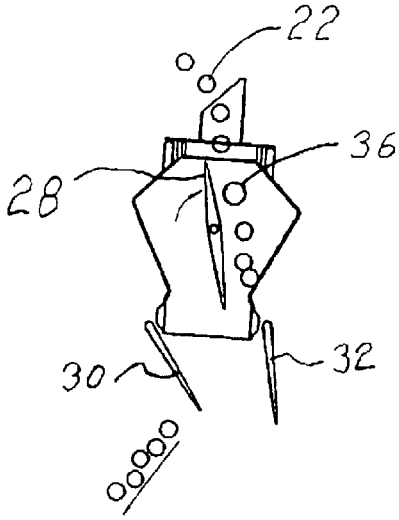
FIG. 7 is an elevational view of the embodiment of FIG. 1 showing the diverter gate opening to allow a second batch to pass to the next position and showing the reject gate in an open position.
Figure 8:
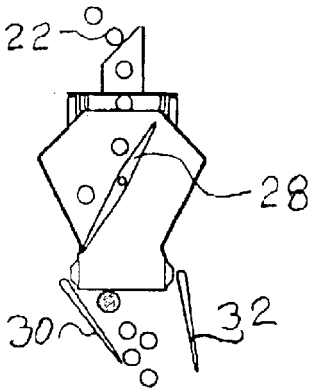
FIG. 8 is an elevational view of the embodiment of FIG. 1 showing a second batch being rejected while the diverter gate is in a holding position for another batch.
Figure 9:
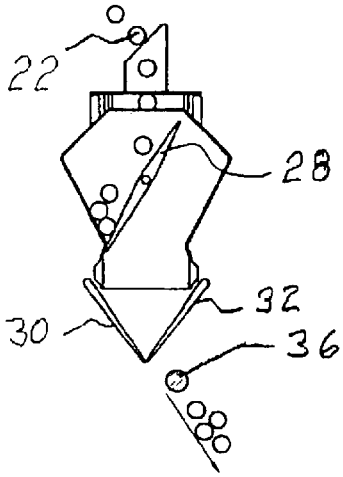
FIG. 9 is an elevational view of the embodiment of FIG. 1 showing all gates closed to begin a new cycle.

Typically, the plurality of devices 20 are disposed above a conveyor system (not shown) which moves containers into which the parts 22 will be dispensed. When a container is aligned under device 20, accept gate 30 is opened while reject gate 32 remains closed. This releases an accepted batch to drop into a container, as shown in FIG. 6. Now, as shown in FIG. 7, as the first batch is being dispensed into a container, diverter gate 28 swings between the out-of-specification part 36 and the next entering in-specification part 22, accept gate 30 closes and reject gate 32 opens only when the accept gate 30 is closed. The partial batch containing out-of-specification part 36 is rejected as shown in FIG. 8 while a new batch begins to accumulate. A container, bin, trough, or the like (not shown) is disposed beneath the reject gate to catch the rejected batch. In FIG. 9, the diverter gate 28, accept gate 30, and reject gate 32 are in the positions allowing counting and accumulation of another batch while the rejected batch drops away.

Figure 10:
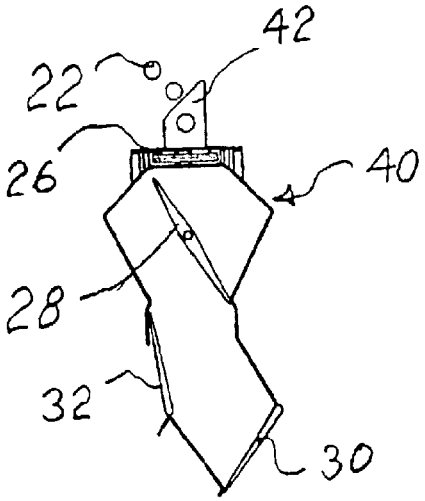
FIG. 10 is an elevational view, schematically shown for illustrative clarity, of another embodiment of the counting and portioning system of the present invention.

A second embodiment of the instant invention, generally designated by the numeral 40, is shown in FIG. 10. Parts 22 which have been singulated by the device 10 enter the system at the inlet end 42 to be optically scanned by scanner 26. Diverter gate 28 is in a first position to accumulate a batch of a predetermined number or volume of parts 22. Accept gate 30 and reject gate 32 are both in the closed positions. In this embodiment, the reject gate 32 is at the side of device 40 rather than at the bottom as in device 20 of the first embodiment.

Figure 11:
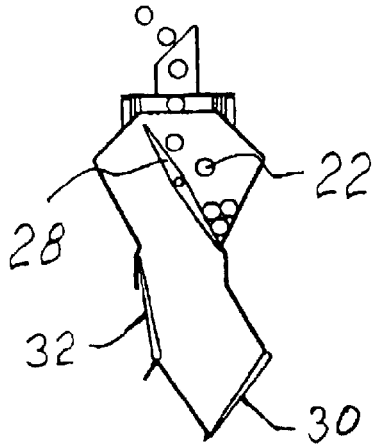
FIG. 11 is an elevational view of the embodiment of FIG. 10 showing the diverter gate in a holding position.
Figure 12:
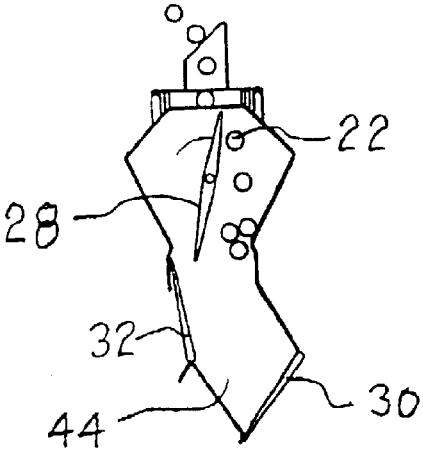
FIG. 12 is an elevational view of the embodiment of FIG. 10 showing the diverter gate allowing a first batch to proceed to a dispensing position.
Figure 13:
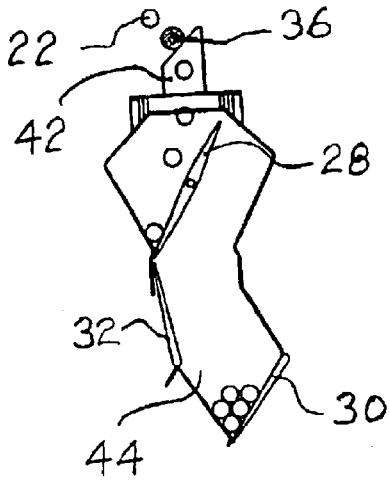
FIG. 13 is an elevational view of the embodiment of FIG. 10 showing the first batch being held for dispensing while the diverter gate is in a holding position for a second batch which will include an out-of-specification article.

In FIG. 11, the parts 22 have all passed through scanner 26, are within the predetermined specifications, and are accumulating. In FIG. 12, the batch count is completed, that is, the predetermined number or volume of parts 22 have accumulated. The diverter gate 28 swings to its second position allowing the first batch to drop down into the holding area at the outlet end 44 of device 40. Accept gate 30 and reject gate 32 are still closed. As shown in FIG. 13, while the first batch is being held at 44, a new batch is entering at inlet end 42, with diverter gate 28 holding the new batch. The new batch shown will include a part 36 which is out of specification.

Figure 14:
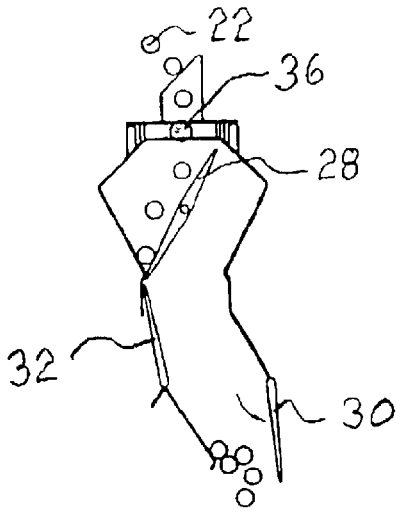
FIG. 14 is an elevational view of the embodiment of FIG. 13 showing the first batch being dispensed while the diverter gate is in a holding position for a second batch.
Figure 15:
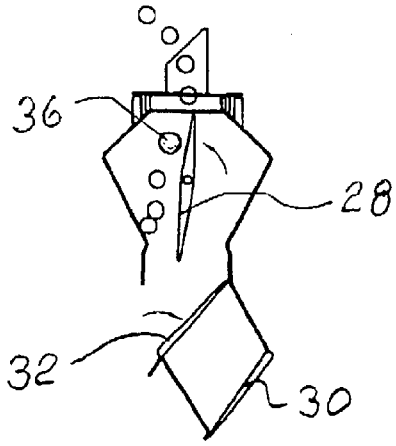
FIG. 15 is an elevational view of the embodiment of FIG. 10 showing the diverter gate opening to allow a rejected batch to pass to the next position and showing the reject gate in an open position.
Figure 16:
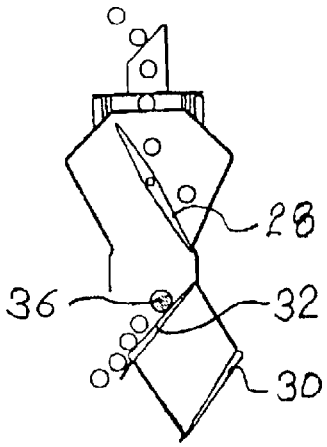
FIG. 16 is an elevational view of the embodiment of FIG. 10 showing a batch being rejected, while another batch is being held for dispensing and while the diverter gate is in a holding position for still another batch.
Figure 17:
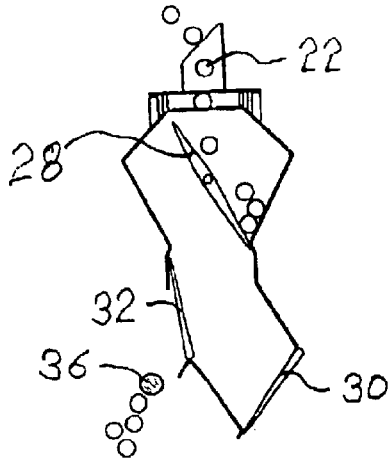
FIG. 17 is an elevational view of the embodiment of FIG. 10 showing all gates closed to begin a new cycle.

When a container is aligned under device 40, accept gate 30 is opened while reject gate 32 remains closed. This releases an accepted batch to drop into a container, as shown in FIG. 14. Now, as shown in FIG. 15, the first batch has been dispensed into a container, diverter gate 28 swings between the out-of-specification part 36 and the next entering in-specification part 22, accept gate 30 is closed and reject gate 32 opens only when the accept gate 30 is closed. The partial batch containing out-of-specification part 36 is rejected as shown in FIG. 16 while a new batch begins to accumulate. As in the first embodiment, a container, bin, trough, or the like (not shown) is disposed beneath the reject gate to catch the rejected batch. In FIG. 17, the diverter gate 28, accept gate 30, and reject gate 32 are in the positions allowing counting and accumulation of another batch while the rejected batch drops away.

According to the method of the present invention, a flow of articles separated by discrete intervals is provided to at least one portioning device 20, 40 positioned to receive the articles. Using the scanner 26, a count of articles that are received in the at least one portioning device and/or fall within a predetermined range of a predetermined specification such as volume, size, color, weight, or the like is calculated. The predetermined specification could be, for example, volume of an individual article or total volume of an aggregate group of articles. The at least one device is emptied into a first location when the count maintained by the detector is equal to the predetermined number. When articles in the flow that fall outside the predetermined range of size, weight, volume, or the like, however, an out-of-specification signal is generated. The at least one device is emptied into a second location in response to the generation of an out-of-specification signal.

As already discussed, the first location may be, for example, a package for receiving one lot of articles having the predetermined specifications. The package may be situated on a second conveyor that moves packages sequentially into the first location. The second location may be, for example, a container for receiving and storing groups of articles that include articles that fall outside the predetermined specifications such as total volume.

Figure 18:
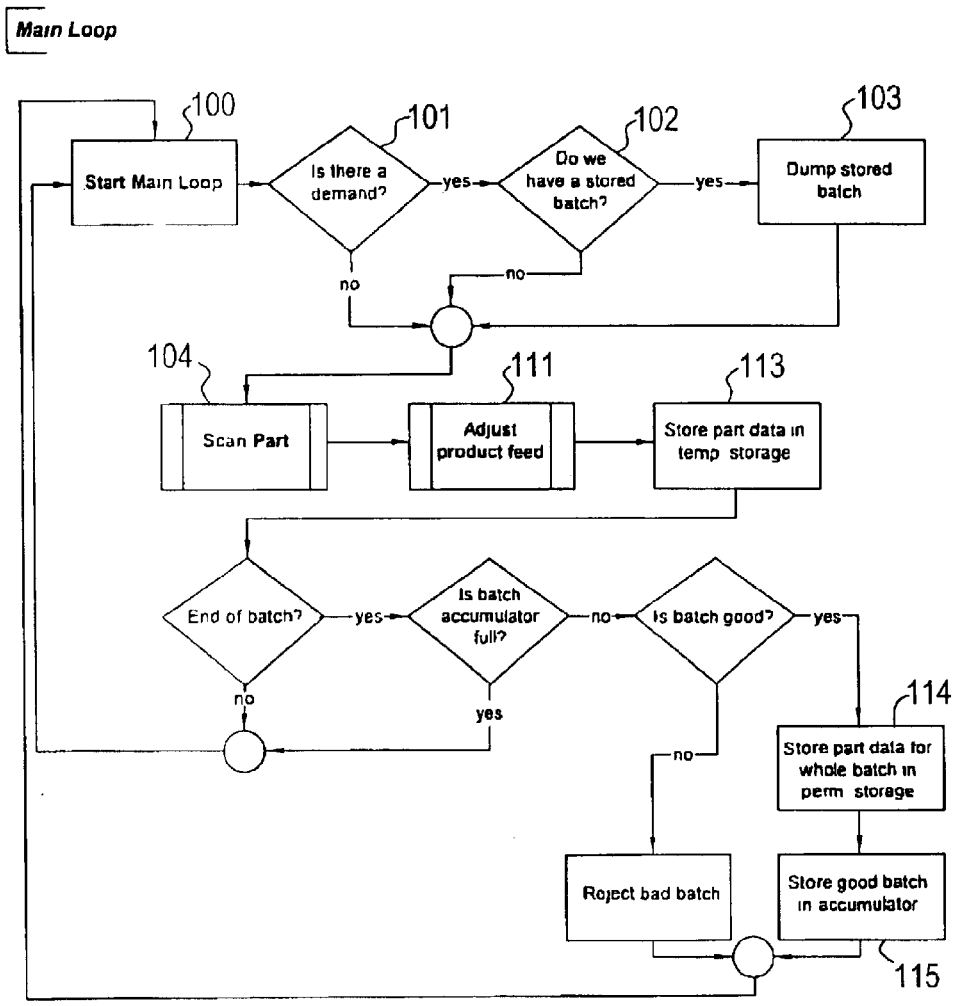
FIG. 18 is a flow chart diagram of a method for detecting and counting articles that are within a predetermine range of a desired property into lots according to the present invention.

FIG. 18 is a flow diagram for operating a method according to the present invention. The main loop is started at 100. Then, in step 101, it is determined whether there is a demand (i.e., whether there is a first location capable of accepting the counted articles, such as a package in which a preset number or volume of articles is to be filled). If there is a demand, the counter unit determines whether any lots are ready for packaging, that is, whether there is a stored batch, at 102. If there is a stored batch, the accept gate is opened and that stored batch is dumped at 103.

Even if there is no demand at 101, or if there is no stored batch at 102, an incoming stream of product is scanned at 104.

Figure 19:
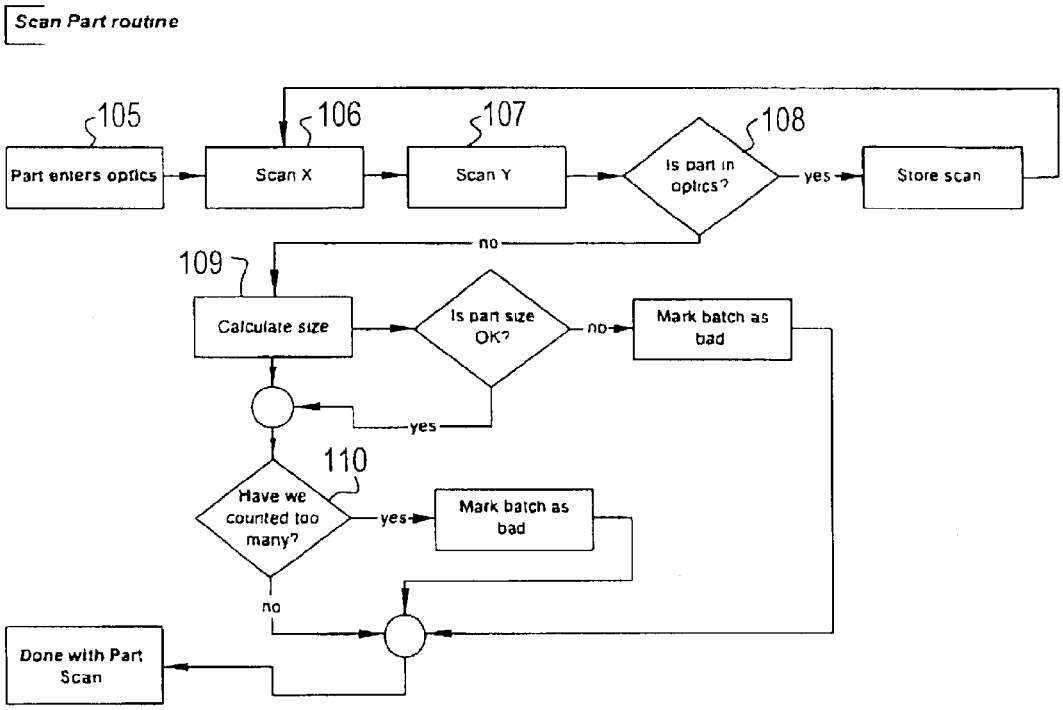
FIG. 19 is a flow chart diagram of a sub-routine of the diagram of FIG. 18

The scan part routine is shown in the flow diagram of FIG. 19. The part enters the optics at 105. Different characteristics are scanned denoted as "scan X" 106 and "scan Y" 107. The routine queries whether the part is in the optics at 108. If yes, the scan is stored. If no, the size of the part is calculated at 109. If the part size meets specifications, the batch count or volume is tallied and calculated at 110. At this point, the part scan is finished unless a part is off-size or the batch number is wrong, in which case the batch is marked as bad.

Figure 20:
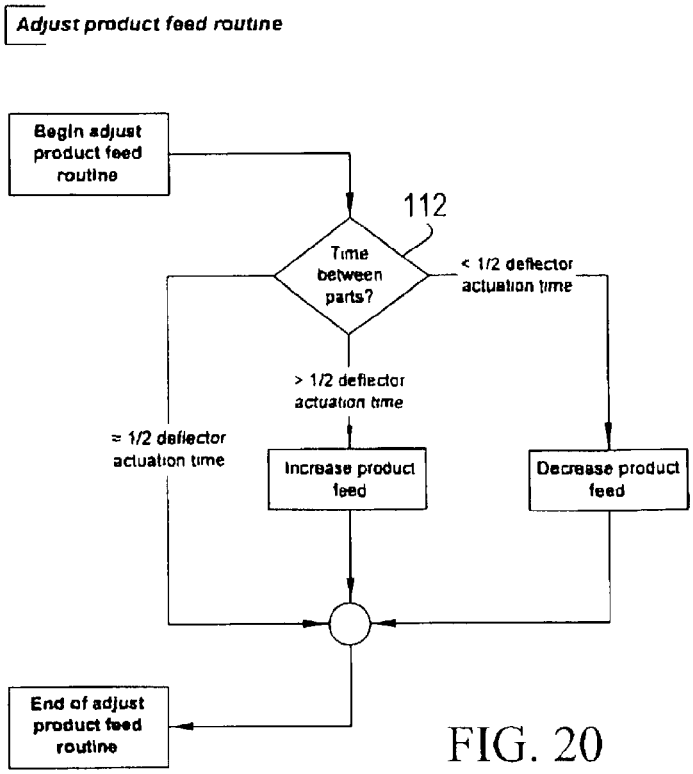
FIG. 20 is a flow chart diagram of another sub-routine of the diagram of FIG. 18.
Figure 21:
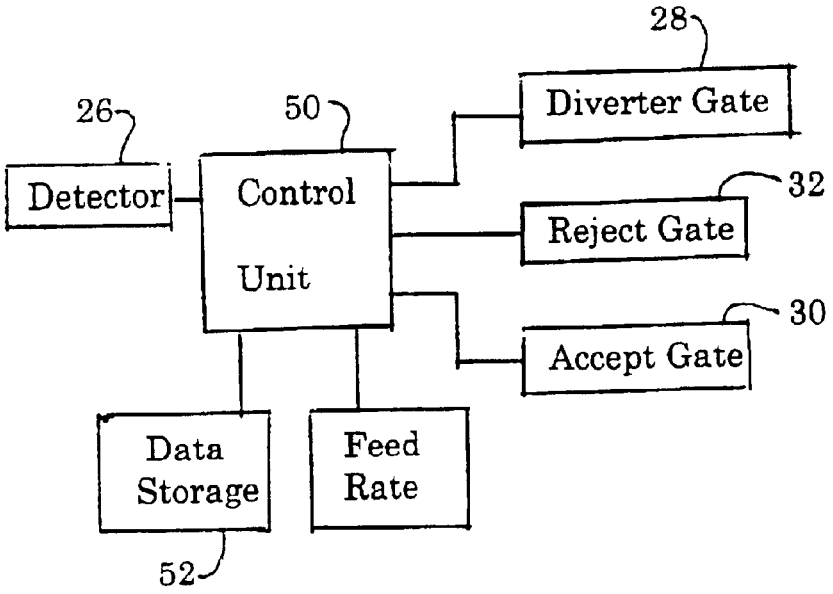
FIG. 21 is a schematic diagram of a counting and portioning system according to the present invention.

After scanning, the method determines whether the product feed needs adjustment at 111 (FIG. 18). The adjust product feed routine is shown in the flow diagram of FIG. 20. If the flow of articles is too fast for the diverter or deflector gate to separate them, as determined in step 112, the product feed is decreased, thereby slowing the flow of articles to the scanner.

Returning to FIG. 18, after product feed is adjusted, if necessary, part data is stored in temporary storage at 113. If the batch is finished, the batch accumulator is not full, and the batch is good, the part data is stored in permanent storage at 114 and the batch is stored in an accumulator at 115. The profile of every item passing through the system is stored for future reference.

The method of the present invention includes counting and/or detecting a predetermined physical characteristic of the articles by detector 26 which sends the count and in-specification or out-of-specification signal to control unit 50. Control unit 50 sets the diverter gate 28 in the proper position and opens the appropriate accept gate 30 or reject gate 32. Responsive to the incoming feed rate, control unit 50 also re-sets feed rate. Information about the batches of articles is stored in data storage 52.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within scope of the present invention.

What is claimed is:

1. A system which portions discrete articles which are within a predetermined range of a predetermined specification, said system comprising:

A. a detector unit which detects and maintains a tally of articles that are received in said system and fall within said predetermined range of a predetermined specification, which detector generates an out-of-specification signal when an article received in said system falls outside said predetermined range; and B. a device which comprises:

(1) a portioning bin positioned to receive articles from a flow of articles delivered to said device;

(2) a diverter gate which holds and releases batches of articles for further processing, said diverter gate being disposed in said portioning bin;

(3) at least first and second outlet gates for emptying articles from said device into respective first and second locations which are separated from each other; and (4) a control unit which causes said diverter gate to move between a first position where it holds a batch of said articles and a second position where it releases a batch of said articles for further processing; and which causes said first outlet gate to open when the articles fall within the predetermined range of the predetermined specification, and causes said second outlet gate to open in response to receipt of an out-of-specification signal from said detector unit.

2. A system according to claim 1, wherein:

said first location comprises a package for receiving one lot of said articles; and said second location comprises a container for receiving and storing groups of articles which include articles that fall outside the predetermined range of a predetermined specification.

3. A system according to claim 2, wherein said package is situated on a conveyor which moves packages sequentially into said first location.

4. A system according to claim 1, further comprising a feed conveyor, said feed conveyor comprising:

a hopper for receiving bulk quantities of articles to be counted; and at least one chute for delivering said flow of articles to said at least one device.

5. A system according to claim 4, comprising a plurality of devices disposed about a periphery of said hopper, with one chute associated with each respective device.

6. A system according to claim 1, wherein said predetermined specification specifies color.

7. A system according to claim 1, wherein said predetermined specification specifies size.

8. A system according to claim 1, wherein said predetermined specification specifies weight.

9. A system according to claim 1, wherein said predetermined specification specifies volume.

10. A system according to claim 1, wherein said control unit causes said first outlet gate to open when the count of articles is equal to a predetermined number and the articles fall within the predetermined range of the predetermined specification, and causes said second outlet gate to open in response to receipt of an out-of-specification signal from said scanner.

11. A system according to claim 10, wherein said predetermined specification specifies volume.

12. A system according to claim 1, wherein:

said first location comprises a package for receiving one lot of said articles; and said second location comprises a receptacle for receiving groups of articles which include articles that fall outside the predetermined range of a predetermined specification and allowing said groups of articles to be conveyed to another location.

13. A system according to claim 1, wherein said portioning bin comprises an upper chamber and a lower chamber; said diverter gate is disposed in said upper chamber such that, in a first position said diverter gate holds articles in said upper chamber until needed, and in a second position said diverter gate releases articles to drop to said lower chamber.

14. A system according to claim 13, wherein said first and second outlet gates are disposed at said lower chamber.

15. A system according to claim 14, wherein said first and second outlet gates, when closed, together, form bottom walls of said lower chamber.

16. A system according to claim 14, wherein said first outlet gate, when closed, forms a bottom wall of said lower chamber and said second outlet gate, when closed, forms a side wall of said lower chamber.

17. A method for portioning discrete articles which are within a predetermined range of a predetermined specification, said method comprising:

A. delivering a flow of articles separated by discrete intervals within said flow;

B. providing at least one portioning bin positioned to receive articles from said flow;

C. detecting and maintaining a record of articles that are received in said at least one portioning bin and fall within said predetermined range;

D. detecting articles in said flow, which fall outside of said predetermined range, and generating an out-of-specification signal when an out-of-specification article is received in said at least one portioning bin;

E. emptying a batch of articles from said at least one portioning bin into a first location when the record maintained in said detector indicates that said articles fall within said predetermined specification; and F. emptying at least a partial batch of articles from said at least one portioning bin into a second location in response to generation of an out-of-specification signal.

18. A method according to claim 17, wherein:

said first location comprises a package for receiving one lot of said articles; and said second location comprises a container for receiving and storing groups of articles which include articles that fall outside the predetermined range of a predetermined specification.

19. A method according to claim 18, wherein said package is situated on a conveyor which moves packages sequentially into said first location.

20. A method according to claim 17, wherein:

said first location comprises a package for receiving one lot of said articles; and said second location comprises a receptacle for receiving groups of articles which include articles that fall outside the predetermined range of a predetermined specification and allowing said groups of articles to be conveyed to another location.

21. A method according to claim 20, wherein said package is situated on a conveyor which moves packages sequentially into said first location.

22. A method according to claim 17, wherein said at least one portioning bin comprises an upper chamber and a lower chamber, said method further comprising:

selectively storing a batch of said articles in said upper chamber until needed and releasing a batch of said articles from said upper chamber upon demand.

23. A method according to claim 17, further comprising:

determining a separation interval between said articles in said flow;

determining a time required to activate said diverter gate; and adjusting a flow rate of articles in said flow, based on said determined separation interval and said determined time.

24. A method according to claim 17, further comprising a computer programmed to:

maintain a tally of articles detected by said scanner, which articles have been received in a currently selected portioning bin;

store scan data on articles in said flow based on said out-of-specification signal;

totalize total volume of scanned product passing the scanner;

open said first outlet gate of said currently selected portioning bin when a count of articles received therein equals said predetermined number and cause said diverter gate to hold a succeeding batch of articles; and open said second outlet gate of said currently selected portioning bin in response to generation of an out-of-specification signal from said scanner.

25. A method according to claim 17, wherein said predetermined specification is selected from the group consisting of number, volume, size, color, weight, and combinations thereof.

26. A method according to claim 25, wherein said predetermined specification is total volume.

27. A method according to claim 17, wherein said predetermined specification is count and total volume.

* * * * *